United States Patent [19]

Drews et al.

[11] 4,222,352

[45] Sep. 16, 1980

[54] ELECTRICALLY CONTROLLED FUEL INJECTION SYSTEM

[75] Inventors: Ulrich Drews, Vaihingen-Pulverdingen; Peter Werner; Helmut Möder, both of Stuttgart; Adolf Kugelmann, Leonberg, all of Fed. Rep. of Germany

[73] Assignee: Robert Bosch GmbH, Stuttgart, Fed. Rep. of Germany

[21] Appl. No.: 678,315

[22] Filed: Apr. 19, 1976

[30] Foreign Application Priority Data

Apr. 18, 1975 [DE] Fed. Rep. of Germany ..... 2517233

[51] Int. Cl.[3] ..... F02B 3/00

[52] U.S. Cl. ..... 123/484

[58] Field of Search ..... 123/32 EA, 139 E; 307/265, 273; 328/207

[56] References Cited

U.S. PATENT DOCUMENTS

| | | | |
|---|---|---|---|
| 3,685,526 | 8/1972 | Hobo et al. | 123/32 EA |
| 3,732,852 | 5/1973 | McGavic | 123/32 EA |

*Primary Examiner*—S. A. Cangialosi

*Attorney, Agent, or Firm*—Edwin E. Greigg

[57] ABSTRACT

A fuel injection control circuit includes a monostable multivibrator for generating injection valve control pulses. The circuit includes a trigger sub-circuit which controls the switching characteristics of the monostable multivibrator in a well-defined manner which is immune to electrical noise and to voltage fluctuation in the supply lines of the vehicle.

20 Claims, 3 Drawing Figures

ELECTRICALLY CONTROLLED FUEL INJECTION SYSTEM

BACKGROUND OF THE INVENTION

The invention relates to an electrically controlled fuel injection system for internal combustion engines. It relates particularly to engines which employ external ignition and which include at least one, preferably several, electromagnetically actuatable fuel injection valves, at least one of these valves associated with each of the engine cylinders. The fuel injection system for these engines would normally be connected with a control multivibrator circuit connected to a final control element. The control multivibrator includes a capacitor whose discharge time determines the switching state of the circuit and hence the duration of fuel injection. Constant current sources serve to supply current for charging and discharging the capacitor in the multivibrator and the behavior of these constant current sources is dictated on the basis of the air flow rate and the rpm of the engine.

A known fuel injection system of this general type includes a power output stage in series with the magnetic windings of the injection valves and includes at least one semiconductor switching element. Connected ahead of this power output stage is a so-called dividing control multivibrator which switches in synchronism with the crankshaft rotations of the engine while the injection valves are opened simultaneously. This multivibrator is held in its unstable state during the discharge time of a capacitor for defining the fuel injection duration. This capacitor is charged prior to discharge during a predetermined angular path of the crankshaft while the discharging process is defined by the air quantity supplied to the engine. For this purpose, the induction tube of the internal combustion engine preferably includes an air flow rate meter which generates an electrical variable associated with a time average of the air flow rate for steering the charging and discharging process of the capacitor.

This known circuit is designed to be used with injection valves which receive fuel under constant pressure so that the fuel injection system merely defines the opening time of the injection valves and thereby defines the quantity of fuel fed to the cylinders. This fuel injection system receives a trigger pulse during each crankshaft rotation, preferably from the ignition system of the engine, and this pulse is fed to a pulse shaping circuit and, if necessary, a frequency divider circuit and is supplied to the above-mentioned so-called dividing control multivibrator circuit whose output pulse substantially defines the injection duration for the fuel injection valves. This circuit, which will be designated as a control multivibrator circuit in the following text, may be further associated with a pulse extension circuit as well as a voltage correction circuit so that additional conditions may be considered, for example a dependence on the throttle valve position, a fuel enrichment during starting or post-starting as well as a warm-up enrichment.

In principle, the control multivibrator circuit is so constructed that the duration of the pulses which are generated and thus the fuel injection duration depend, preferably, on a control voltage which depends on the air flow rate and which is preferably adjusted by means of a potentiometer, as well as on the rpm. The output pulse $t_p$ must be a signal proportional to the air flow rate Q which is then divided by the number of suction strokes in the time interval, i.e., by the rpm of the crankshaft, so as to obtain an injection signal which corresponds to the air quantity for each suction stroke. In this manner, an approximately correct stoichiometric mixture is obtained in the entire air flow rate and rpm domain. The generation of the injection pulses $t_p$ and the appropriate division by the rpm is performed in the control multivibrator circuit.

The above described circuit may, however, introduce certain difficulties due to the effects of extraneous and disturbing voltages that may occur in the vehicle which carries the internal combustion engine and these voltages may have deleterious effects on the operation of the control multivibrator circuit. For example, the potential at the base of the trigger transistor is defined by the charge of the capacitor connected to it whereas the emitter of this transistor is exposed to extraneous induced voltages, due, for example, to the ignition system, the alternator and several other switches. Under certain unfavorable circumstances, extraneous simulated trigger pulses may occur because the charge on the capacitor is unable to adapt rapidly enough. Another possible advantage is due to the accumulation of individually very small but finite propagation times of the signals in the feedback networks of the control multivibrator. These delays may lead to an error in division because the pulse time $t_p$ appears to be shortened by these rpm independent times.

OBJECT AND SUMMARY OF THE INVENTION

It is thus a principal object of the present invention to provide an improved control multivibrator circuit for an electronic fuel injection system. The improvement is directed to providing circuitry which makes the control multivibrator circuit insensitive to extraneous induced voltages. It is a further object of the invention to provide circuitry which makes the recharge time of the capacitor in the control multivibrator and, hence, the duration of the fuel injection pulse, exclusively dependent on the rpm and air flow rate information fed to the circuit.

These objects are attained according to the invention in a fuel injection system of the type defined above by providing a trigger circuit connected ahead of the monostable multivibrator in the control multivibrator circuit. This trigger circuit directly controls the onset of the fuel injection control pulse $t_p$ and, at the same time, flips the monostable multivibrator into its unstable state so as to define the output pulse duration due to the controlled manner of recharging the capacitor in the multivibrator circuit.

Thus derives the advantage that the trigger pulse for the control multivibrator circuit, which normally is sufficiently intense, is generated by that circuit at the output virtually at the same time while the duration of the output pulse is determined by the capacitor recharge process. Thus, signal propagation times are eliminated. A further advantageous embodiment of the invention provides that the control multivibrator circuit is self-latching so that the return into its normal stable condition occurs without any delay and thay any possibility for oscillatory behavior during the transition in which both of the switching elements in the multivibrator are partially conducting is thereby eliminated.

The invention will be better understood as well as other objects and advantages thereof become more apparent from the ensuing detailed description of a preferred embodiment taking in conjunction with the drawing.

DESCRIPTION OF THE PREFERRED EMBODIMENT

Figure 1:
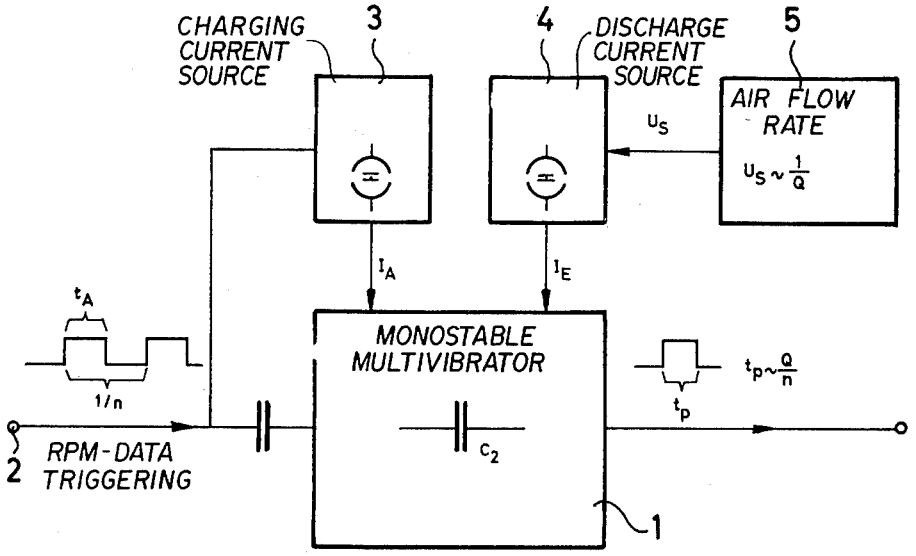
FIG. 1 is a principal block diagram of the control multivibrator according to the invention with its associated constant current sources.
Figure 2A:
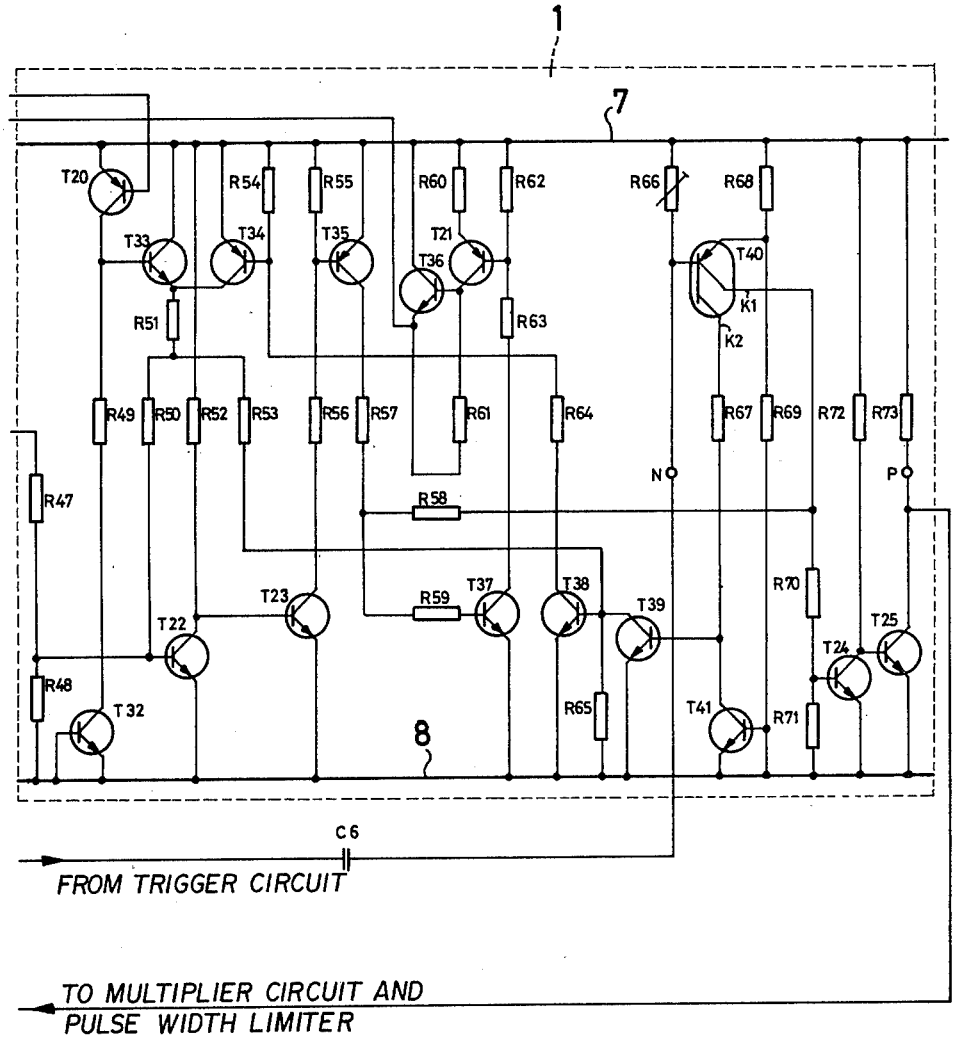
FIGS. 2*a* and 2*b* together represent the detailed circuit diagram of the circuit of FIG. 1.
Figure 2B:
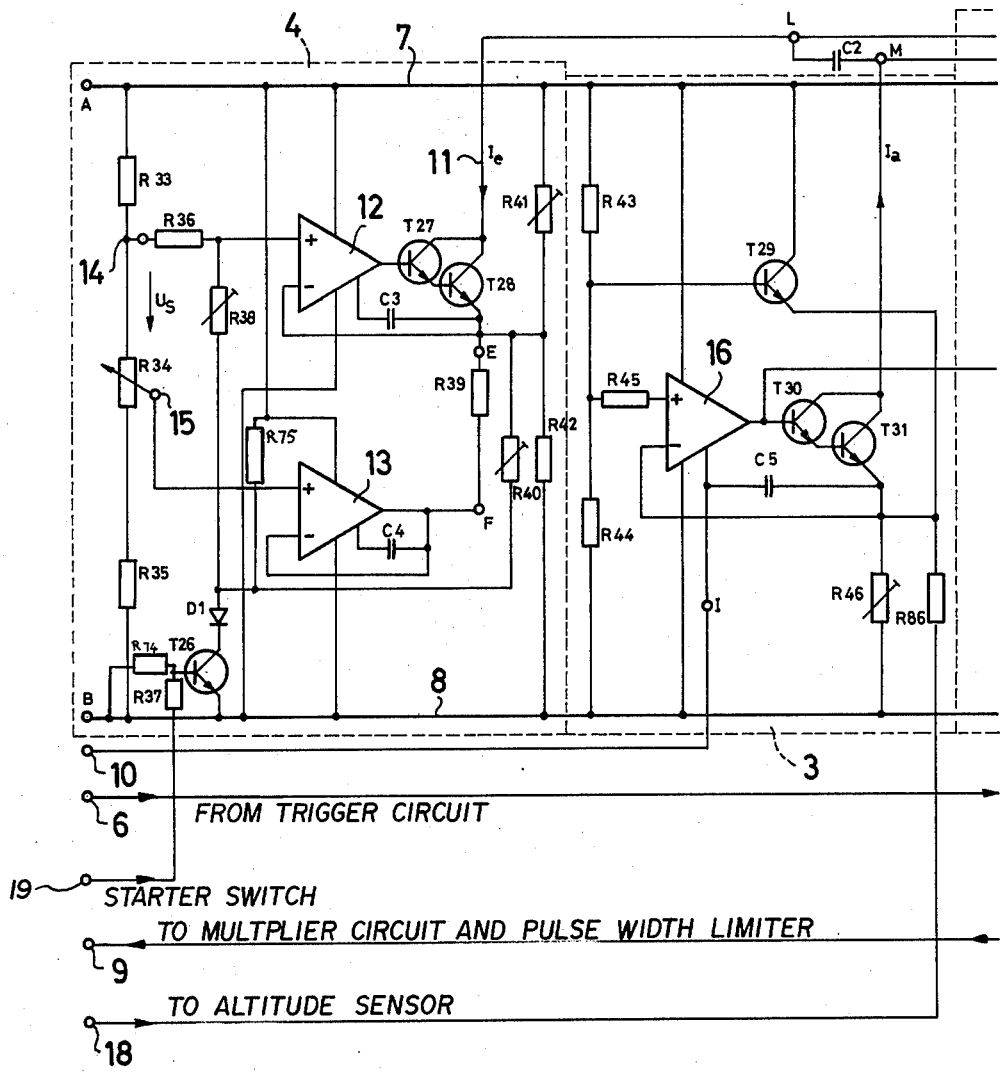

Turning now to FIG. 1, there will be seen a block diagram of the invention showing the monostable multivibrator 1, including a capacitor $C_2$; the control multivibrator 1 receives at a contact 2 a trigger pulse which contains rpm related information. Thus, the output of the control multivibrator 1 generates the output control pulse $t_p$ which carries information related to the air quantity for each suction stroke. A charging current source 3 and a discharge current source 4 are associated with inputs to the monostable control multivibrator and a sub-circuit 5 feeds to the discharge current source 4 information regarding the air quantity supplied to the inernal combustion engine. FIGS. 2*a* and 2*b* together represent a detailed circuit diagram of the elements in FIG. 1. In order to facilitate understanding, those semiconductor switching elements, normally transistors, which cooperate, form multivibrators or are used as feedback networks will now be pointed out in advance. The monostable multivibrator which forms the heart of the control multivibrator circuit 1 is formed from two transistors T20 and T21 and the collector of T21 is connected to the capacitor $C_2$ defining the time constant of the monostable multivibrator, firstly through a resistor R61 and secondly via an intermediate transistor T36. The other electrode of the capacitor $C_2$ is connected to the base of the transistor T20. The trigger circuit which controls the monostable multivibrator includes a transistor T40 and an output stage which generates the output pulse $t_p$ is formed from transistors T24 and T25. The circuit also includes a bistable auxiliary multivibrator which aids in the resetting operation and is formed substantially from transistors T38 and T34. The remaining transistors shown are control transistors or are part of a feedback network. Their connection and function will be explained in conjunction with the following description of the operation of the circuit according to the invention.

It should be pointed out that the capacitor $C_2$ which defines the unstable state of the monostable multivibrator formed by transistors T20 and T21, as may be seen in FIG. 2*b*, also lies in the input circuit of the charging current source 3 and the discharge current source 4 whose detailed construction will be treated below.

In FIG. 2*b*, the rectangular trigger pulse flows from the input contact 6 to the capacitor $C_6$ and hence to the base of the transistor 40, also connected through a resistor R66 to the positive supply rail 7. The negative supply rail of the circuit is designated with the numeral 8. Of course, these designations may be reversed depending on the type of transistor used and the types of other circuit elements are only given as examples in the particular embodiment which is described here.

The rear edge of the rectangular trigger pulse J, formed by the differentiation by the capacitor $C_6$, triggers the base of the transistor T40, and the uncharged capacitor $C_6$ is then charged by the base current of the transistor T40 which thereby becomes conducting during the recharge time of the capacitor $C_6$. During this time, the trigger circuit formed by this transistor T40 delivers a control current to the two collector contacts K1 and K2 of the transistor T40. Thus, immediately after the transistor T40 is triggered, the collector K1 actuates the output circuit formed by the transistors T24 and T25, blocking the output transistor T25 and rendering T24 conducting.

While the same collector K1 of the transistor T40 also actuates elements belonging to the monostable multivibrator via the resistor R58, nevertheless the simultaneous and immediate actuation of the output stage permits the generation of the output pulse practically at the same time as the onset of triggering, without waiting for the flip-over of the monostable multivibrator. The triggering of the transistor T40 results in a potential shift at the collector K2 an this event will be described in more detail below. The transistor T40 is a so-called lateral transistor. Due to triggering the transistor T40, there is a definite potential shift at both of its collectors in the positive direction so that, for the short period of time during which the transistor T40 conducts due to having received a trigger pulse, the transistor T37 controls the resistors R58 and R59 also conducts and shifts the potential at the base of the transistor T21, which belongs to the monostable multivibrator, in the negative direction until the transistor T21 and its associated transistor T36 both conduct. (The two transistors 21 and 36 form a so-called LIN circuit.)

Structurally, the emitter of the lateral transistor T40 is connected through a resistor R68 to the positive supply line and through a resistor R69 to the negative supply line while its connector K1 is connected in series with a resistor R70 and a resistor R71 to ground. The junction of these two latter resistors is connected to the base of the first transistor T24 in the output stage whose emitter is grounded and whose collector is connected to the positive supply line through a resistor R72. The collector of the transistor T24 is also connected directly to the base of the output transistor T25 whose emitter is grounded and whose collector is connected to the positive supply line through a resistor R73. The collector of the output transistor T25 includes the output contact 9 of the entire control multivibrator circuit and may preferably be joined to a multiplying circuit and a pulse width limiting circuit before being fed to the fuel injection valve.

The base of the transistor T37 is driven through resistors R58 and R59 from the collector K1 of the transistor T40 and the emitter of the transistor T37 is grounded. Its collector is connected in series with a resistor R62 and a further resistor R63 to the positive supply line while the junction of these two latter resistors is connected to the base of the transistor T21 whose own emitter is joined to the positive supply line 7 via a resistor R60 while its connector is connected through a resistor R61 firstly to one electrode M of the capacitor C2, and secondly to the emitter of a subsequent emitter follower transistor T36. The emitter of transistor T21 is joined to the base of the transistor T36 and the collector of transistor T36 is connected directly to the positive supply line. Inasmuch as the LIN circuit of the transistors T21 and T36 conducts after the monostable multivibrator has been triggered, the potential at the electrode M of the capacitor C2 is raised to the positive supply potential diminished only by the conducting voltage drop of the transistor T36 plus the saturation voltage of the transistor T21. The charge on the capacitor C2 remains intact and has a certain predetermined value as will be explained below, and accordingly, during the flip-over of the multivibrator, the voltage at the capacitor electrode L goes beyond the plus potential and the transistor T20 is blocked. Until this point, the discharge current from the discharge current source 4 had been flowing into the base of the transistor T20; from this point on, the discharge current flows through the capacitor C2 substantially through the collector-emitter path of the transistor T36, the contacts M and L of the capacitor C2 into the collector of the transistor T28 which is the output transistor in a Darlington circuit also containing the associated transistor T27 of the discharge current source. Thus, the charge on the capacitor C2 is reversed and the voltage at its electrode L decreases in the direction of negative values until the transistor T20 again conducts and initiates the resetting of the control multivibrator circuit. The time period between the blockage of the transistor T20 and its return to a conductive state represents the unstable time constant of the monostable multivibrator and thus becomes a measure for the duration of the output control pulse $t_p$. The return of the multivibrator to its normal state is accomplished by the transistors in the feedback branch, namely a transistor T33 controlled by the transistor T20, a transistor T22, and a subsequent transistor T23 which controls the transistor T35 which acts through the transistor T37 to block the second transistor T21 of the monostable multivibrator. The circuit also includes an auxiliary resetting sub-circuit which will be explained below. These circuit elements are connected as follows. The emitter of transistor T20 is connected to the positive supply line 7 while its collector is grounded through a resistor R49 and the collector-emitter path of the transistor T32.

The base of the transistor T32 is also grounded and, accordingly, the transistor may be regarded as a normally high resistance in the considerations to follow. Connected to the collector of the transistor T20 is the base of a transistor T33 which it controls and its collector in turn is connected to positive potential while its emitter is connected in series with a resistor R51 and a resistor R50 to the base of the subsequent transistor T22. The emitter of the transistor T22 is grounded and its collector is connected to the positive supply line through a resistor R52. Thus, when the transistor T20 conducts, the base of the transistor T33 is substantially at positive potential and it, therefore, becomes conducting and also renders conducting the subsequent transistor T22. The base of the transistor T23 which constitutes the direct feedback path of the monostable multivibrator is connected to the collector of transistor T22 while its emitter is grounded and its collector is connected through series resistors R56 and R55 to the positive supply line. In the described state of the circuit, the transistor T22 will thus be blocked. At the same time, the transistor T35 whose base is connected to the junction of resistors R555 and R56 is also blocked, its emitter being connected to the positive voltage and its collector being connected through the series resistors R57 and R59 to the base of the transistor T37. The emitter of transistor T37 is grounded and its collector is connected to the positive supply line through resistors R62 and R63. Since the base of the transistor T37 is controlled by the collector of the blocked transistor T35, the transistor T37 also blocks, so that the transistor T21 can no longer be kept conducting and blocks as well, since its base is connected to the junction of resistors R62 and R63 and thus practically resides at the same potential of the positive supply line as does the emitter of the transistor T21. The transistor T36 blocks along with transistor T21 so that the potential at the electrode L floats, since only blocked semiconductor paths are connected to it. This is desirable because in this process the base emitter potential of the transistor T20 is shifted by approximately 100–200 mV which might cause a charging error in the capacitor C2 if the potential at the electrode M were clamped. Such an error could be significant when the engine operates at high rpm and with relatively short charging strokes.

As already mentioned, in this stable switching state of the monostable multivibrator, the discharge current still flows fully into the base of the transistor T20 and thus keeps the monostable multivibrator in this stable condition. While the monostable multivibrator had been in its metastable state, with the transistor T20 in the blocked condition, the transistor T35 was conducting so that the series connection of resistors R57, R58 held the base of the transistor T24 at a sufficiently high positive potential to keep it conducting so that the output transistor T25 remained blocked for generating an output pulse $t_p$. In the metastable state, the collector potential of the transistor T35 kept the transistor T37 conducting via resistors R57 and R59 so that the monostable multivibrator was latched in the meta stable state and could be flipped back into its normal stable state only after the charge exchange of the capacitor C2.

When the monostable multivibrator circuit flips back to its stable state it may produce an erroneous condition which might lead to a falsification of its time constant. In the practical, exemplary embodiment, the discharge current for the capacitor C2 may vary in the region between approximately 100 μa and 10 mA due to the influence of air flow rate and supply battery voltage fluctuations. Therefore, especially when the discharge current is small, and prior to the flip-back of the monostable multivibrator into its stable state, the transistor T20 becomes conducting only slowly because the main portion of the discharge current still flows through the capacitor C2 while the necessary base emitter potential at the transistor T20 which is required for the flip-back increases. At the same time, there already flows a certain amount of base current in this transistor. At this time, the transistor T20 no longer fully blocks but is in an active operational region at the same time as the transistors T21 and T36 which form the other side of the circuit so that, together with portions of the feedback circuit, an oscillatory behavior could take place which would result in the above-mentioned falsification of the time constant of the monostable multivibrator.

Thus, it is a further characteristic of the invention to provide the already referred-to bistable multivibrator formed by transistors T34 and T38 which is provided to prevent this type of oscillation and to abruptly flip the monostable multivibrator back into its stable state and to be latched there.

The bistable multivibrator formed by transistors T34 and T38 is set by the collector current of the transistor T40 flowing through the resistor R67. This same transistor T40 causes the flip of the monostable multivibrator to its metastable state via its collector K1 and the resistor R58. At the same time, the transistor T39 whose emitter is grounded is made conducting by the current flowing to its base through the resistor R67 and thus blocks the transistor T38 whose own emitter is grounded and whose collector is connected through series resistors R54 and R64 to the positive supply line. The junction of these two latter resistors is connected to the base of the transistor T34 which is thereby controlled by the transistor T38 and is also blocked so that the bistable multivibrator formed by these two transistors is set. The collector of transistor T34 is connected to the positive supply line 7 and its collector is connected to the emitter of the transistor T33 associated with the transistor T20 and is thus grounded through the resistors R51, R53 and R65 as well as being connected to the base of the transistor T38.

The values of the various resistors are so chosen that, when the transistors T20 and T33 gradually become conducting, the transistor T38 of the bistable multivibrator responds at a smaller collector current of the transistor T33 than the transistor T22 in the actual feedback path. Thus, the bistable multivibrator flips into its other state due to the conduction of its transistor T38 and its transistor T34 prior to the response of the feedback loop of the monostable multivibrator and, in any case, independently thereof. Thus, in a manner of speaking, the conducting transistor T34 overtakes the transistor T20 independently of the latter's condition, including an oscillatory condition, and the feedback is established abruptly by the potential shift at the collector of the transistor T34 or at the emitter of the transistor T33 in the direction of positive values.

The junction of the collector of the transistor T34 and the emitter of the transistor T33 is connected to a resistor R51 whose other side is connected to the parallel arrangement of two resistors R50 and R53, resistor R50 being connected to the base of the transistor T22 and the resistor R53 being connected to the base of the transistor T38. This feedback permits the two transistors T38 and T34 to rapidly attain their respective switching states.

In the meantime, i.e., before the monostable multivibrator has shifted from its metastable state back to its stable state, the trigger pulse fed to the transistor T40 has decayed and the output circuit, controlled through the resistor R58 now follows exactly the switching behavior of the actual control multivibrator circuit.

The trigger circuit of the transistor T40 is extraordinarily immune to extraneous voltages because both the base and the emitter are connected to the positive supply line through resistors R66 and R68, respectively, and the capacitor C6 charges to the full potential of the line 7. The emitter of the transistor T40 is at lower than positive potential by an amount determined by the value of resistors R68 and R69 so that, assuming that the base is held at constant potential by the charge on the capacitor C6, any voltage fluctuation in the supply voltage of the system which might be transmitted to the emitter of the transistor T40 would have to be of substantial amplitude before the emitter will attain a potential higher than the supply potential in order to conduct.

The sub-circuits which are formed by the transistors T41 and T32 which have already been mentioned above, are socalled residual current sources which accept currents of a predetermined magnitude and which are of practical significance for the design of circuits in the form of integrated circuits (IC). Such residual current sources are used to obtain a more precise operation of the circuit and the transistors whose base and emitter are always at the same potential are practically blocked and thus carry only a well defined residual current.

The trigger circuit shown in FIG. 2*a*, and consisting substantially of the transistor T40 has yet another substantial advantage which may be attained by appropriate sizing of the capacitance of the capacitor T6 and of the adjustable resistor R66.

For if an internal combustion engine is operated in the over-running mode at high rpm, the combination of rpm and the low aspirated air quantity results in a very small nominal injection time. In some engines, a fuel-air mixture of this character is no longer combustible in the cylinder so that uncombusted fuel may enter the exhaust system and may be combusted there explosively. To prevent such an occurrence, it is necessary to limit the minimum duration $t_p$ of the injection pulses and this is done by appropriate dimensioning of the differential circuit for generating the trigger circuit fed to the control multivibrator. As already mentioned, the duration of this trigger pulse depends on the capacitor C6 and the resistor R66 and if the values of these two circuit elements are chosen in the appropriate manner then, independently of the switching time of the monostable multivibrator, the minimum length of the pulse $t_p$ at the output of the transistor T25 may be maintained, since the trigger pulses flow through the transistor T40 and the reversing stage of the transistor T24 directly to the output transistor T25 of the control multivibrator and thus, since their length is not influenced by any action of the monostable multivibrator, they define the minimum length of the pulses which can therefore never be smaller than the shortest duration of the trigger pulse.

As may be seen from FIG. 2*b*, the capacitor C2 which defines the time constant of the monostable multivibrator is discharged via its electrode L by a continuously operating discharge current source 4 in dependence on the air quantity supplied to the internal combustion engine and it is charged through the electrode M from a charging current source 3 which operates in triggered manner by rpm related trigger pulses delivered to its input contact 10.

The construction and operation of the discharge current source 4 will now be explained in greater detail. The current flowing into the discharge current source via the line 11 is determined in dependence on the air quantity supplied to the internal combustion engine and the operational amplifiers 12 and 13 in the discharge current source 4 are controlled in an appropriate manner. In the shown exemplary embodiment, the air flow rate is measured with the aid of a baffle plate disposed in the induction tube of the engine and appropriately deviated by the air flow therethrough. Suitably this baffle plate is connected to the wiper arm of a potentiometer R34. The potentiometer and the free cross section of the baffle plate as a function of its deviation are so made that the control voltage $U_s$ taken off from the potentiometer is inversely proportional to the air quantity Q aspirated by the engine per unit time. It is the job of the discharge current source to use this voltage to generate a proportional and predetermined discharge current $I_e$ which defines the time constant of the monostable multivibrators T20, T21, as already mentioned above. As may be seen in FIG. 2*b*, the potentiometer R34 is connected in series with resistors R33 and R35 across the same supply potential source as is the charging current source and also the entire circuit described in detail with respect to FIG. 2*a*. In this manner, any influence due to fluctuations in the supply voltage are eliminated. It has already been mentioned above that, when the monostable multivibrator switches over, the electrode L of the capacitor C2 is raised to a potential lying higher than the positive supply line. Accordingly, the discharge current works against this raised potential which is never lower than the positive supply line by more than the emitter base voltage drop of the transistor T20.

The discharge current needs to be kept within precise limits, in particular the discharge current source must have a very high internal resistance so as to be independent of the prevailing potential at the contact point L.

The construction of the discharge current source is as follows. A point of fixed potential 14 adjacent the potentiometer R34 is connected through a resistor R36 to the non-inverting input of an operational amplifier 12. The wiper 15 of the potentiometer R34 is connected to the non-inverting input of a further operational amplifier 13. In the usual manner, the operational amplifiers 12 and 13 are connected to positive and negative lines of supply. The inverting inputs of the operational amplifiers 12 and 13 are connected to the contacts E and F, respectively, on opposite ends of a resistor R39. The output of the operational amplifier 13 is connected directly to point F and the output of the operational amplifier 12 is connected to the point E via the Darlington circuit of two transistors T27 and T28. The operational amplifiers 12 and 13 draw only a very small current from the potentiometer and generate the control voltage $U_s$ across the resistor R39. This control voltage $U_s$ is incorrect by the difference of the offset voltages of the two operational amplifiers 12 and 13.

A suitable choice of the resistor R36 at the input of the operational amplifier 12 permits a compensation of any possible temperature drift of the discharge current. Such a compensation is required because the input current at the inverting input of the operational amplifier 12 is added to the discharge current. In the ideal case, the resistor R36 is of the same magnitude as the resistor R39 but a mismatch is not critical and is seen only as a supplementary offset voltage.

Assuming a maximum air flow rate range of 1:40, a practical, exemplary embodiment which assumes a low supply voltage would have, for example, a smallest control voltage $U_s$ of approximately 70 mV. In such a case, the offset voltages of the operational amplifier can no longer be neglected and require compensation. These offset voltages are additive with respect to the control voltage $U_s$ and result in a component in the discharge current which is not air flow rate dependent. As may be seen, the voltage drop across the resistor R39 is too small by the difference of the offset voltages so that the discharge current in the collector circuit of the transistors T27 and T28 is somewhat too small. In order to compensate for these offset voltages, the emitter of the transistor T28 or the point E is connected with the junction of two series resistors R41 and R42 connected between the positive and negative supply voltages. The resistor R41 is an adjustable resistor. The voltage divider formed by resistors R41 and R42 has a high value of resistance and, in the ideal unloaded case, the junction of the two resistors carries the potential of the fixed potential point 14. By the maladjustment with the aid of the resistor R41 one then obtains the compensation because, in spite of the maladjustment, the operational amplifier 12 forces the potential at the junction of resistors R41 and R42 to approximately that of the point 14 so that, depending on the type and extent of maladjustment, a current will flow into or out of the circuit point E. This current is independent of the air flow rate just as the current due to the offset voltage error and is additive with respect to the discharge current. The current flowing through the resistor R39 remains the same because the potential across this resistor is kept constant. The only thing that changes due to the maladjustment of the voltage divider circuit is the current which flows in one direction or the other in the collector circuits of the transistors T27 and T28. In this manner, one obtains a good precision in the transformation of the control voltage $U_s$ into a constant current which serves for the discharge of the capacitor C2.

A further advantage of the discharge current circuit according to the invention is revealed in case, for example, the connection to the points 14 and 15, i.e., to the potentiometer in the air induction region, should be interrupted for any reason. In that case, the potential at the inverting inputs of the operational amplifiers 12 and 13 goes to zero and the current through the resistor R39 stops, with the result that substantially no further discharge current can flow. In such an event, the system goes over into an emergency running condition because the pulse from the control multivibrator is in all cases sufficiently long and may be appropriately limited by a subsequent pulse limiting circuit.

The charging current source 3 has the task of delivering an adjustable and predetermined charging current $I_a$ which is proportional to the supply voltage and which may be turned on and off by an external signal fed to the contact point 10. There should be no delays in switching and the charging current should have a low temperature dependence while the internal resistance of the current source is required to be high.

The charging current source includes an operational amplifier 16 whose non-inverting input is connected through a resistor R45 to the tap of a voltage divider formed by resistors R43 and R44 which are connected between the two sources of potential. The inverting input of the operational amplifier 16 is grounded through an adjustable resistor R46, as is the output through the Darlington circuit formed by transistors T30 and T31. Hence, the operational amplifier 16 operates as a voltage follower which reproduces across the resistor R46 the voltage at its non-inverting input; the resistor R46 therefore determines the charging current $I_a$ and is adjustable. Inasmuch as the input current to the operational amplifier is very small, the current through the resistor R46 also determines the emitter current of the Darlington circuit formed by transistors T30 and T31. The very high current amplification provided by the Darlington circuit results in the desired large internal resistance of the charge current source which is turned on and off by rpm synchronous pulses fed to the input contact 10. When the circuit is turned off, the output of the operational amplifier 16 goes to zero. When turned on, this output carries the voltage across the resistor R46 plus the base emitter voltages of the transistors T30 and T31. In this manner, the voltage divider circuit formed by the resistors R47 and R48 provides a feedback block for the monostable multivibrator due to the connection of the junction of resistors R47 and R48 to the base of the transistor T22 which lies in the feedback path of the monostable multivibrator. In this manner, the transistor T22 is maintained in the conductive state.

One property of the charge current source 3 is an altitude correction element. As is well known, the density of the air decreases with increasing altitude above sea level so that, for each induction stroke of the engine, a smaller mass of air reaches the cylinders. In the previously described air flow rate measurement with the aid of a baffle plate, this decrease in mass cannot be determined completely so that, with increasing altitude, there is an undesirable enrichment of the fuel-air mixture. This enrichment will be canceled by the altitude correction circuit which will be described below. For this purpose, there is included in the system a customary diaphragm sensor which reacts to the ambient air pressure (not shown) which adjusts the wiper of a potentiometer which is connected between the two supply rails 7 and 8 as a function of air pressure. The diaphragm box and the associated potentiometer are so embodied that the voltage at the input contact 18 in FIG. 2*b* becomes more positive with increasing altitude. This voltage is fed through a resistor R86 to the junction of the emitter of transistor T31 and the resistor R46.

When the vehicle in which the system is used is at sea level or a comparable level, the voltage at the resistor R86 is intentionally made equal to that which results from the resistance ratio of the resistors R43 and R44 and which is reproduced across the resistor R46. In that case, the altitude correction circuit does not have any effect. If the potential at the input contact 18 rises, the resulting current flows through the resistor R46 but its voltage drop is held constant by the operational amplifier 16. As a consequence, the current flowing through the emitter collector paths of the transistors T30 and T31 decreases with increasing altitude and, as a result, the charge rate of the capacitor C2 and the time constant of the associated monostable multivibrator also decrease. Thus, the output control pulses $t_p$ are shortened in corresponding manner.

The capacitors C3, C4 and C5 associated with the operational amplifiers 12, 13 and 16, respectively, serve to prevent oscillations of the operational amplifier. However, their presence may lead to switching delays especially for the case of the operational amplifier 16. Such delays are prevented by the presence of the transistor T29 which permits the charge on the capacitor C5 to change only very slightly during a switching process.

A further property of the discharge current source 4 is that it includes a mechanism to define the fuel-air mixture during the starting of the engine. Under those conditions the air flow rate meter cannot give a reliable indication of the very small air current through the induction tube. Accordingly, this sensor delivers a signal equal to the idling signal and independent of the air quantity. During normal operation, the degree of charging of capacitor C2 increases with decreasing rpm. Below a certain rpm, lower than idling rpm but above that which occurs during the starting, further charging of the capacitor C2 is limited due to the saturation of the transistor T30. Thus, the same injection time is obtained independently of the starting rpm. This injection time can be changed only by changing the discharge current of the capacitor during the starting period. In most engines, the duration of injection during starting must be extended automatically over that which is normally used. However, for some engines a shortening of the injection time is required. Both of these possibilities are accounted for by a transistor T26 whose emitter is connected to the supply line 8 and which is held conducting during the starting. This state may be insured, for example by a starting switch (not shown) connected to the contact 19, which connects one side of the resistor R37 to the supply line 7 during starting. The other side of this resistor is connected to the base of the transistor T26 and this electrode is also connected throug a resistor R74 with the supply line 8 to carry away residual currents.

The control of the transistor T26 may also be effected by a suitable signal from the engine starter, for example by connecting the contact 19 in FIG. 2*b* with the starter contact 50. Accordingly, the transistor T26 conducts during engine start-up. If a fuel enrichment is desired during starting, i.e., an extension of the injection time, this may be obtained with the adjustable resistor R38. When the transistor T26 conducts, the resistor R38 and the resistor R36 together form a voltage divider which has the result that the potential at the non-inverting input of the operational amplifier 12 is lowered with respect to the potential of the supply line 8. in the discharge current source 4, described above, this means a diminution of the control voltage of the air flow rate meter and thus results in an extension of the injection time. The resistor R40 is not required in this case. However, if a shortening of the injection time is required during starting, this result may be obtained by the adjustable resistor R40 connected to the contact E. In such a case the resistor R38 is superfluous. Due to the additional current added to the normal discharge current, the injection time is shortened.

FIG. 2*b* also shows a resistor R75 which is connected between the collector of transistor T26 and the supply line 7. This resistor, in connection with the diode D1, represents a characteristic of the invention which permits conducting away the residual current of the collector-emitter path of the transistor T26 which does not completely vanish even in the blocked condition of this transistor, so as to prevent its influence on the discharge current source. If the resistor R75 were not present, the residual current would be added to the discharge current in the presence of the resistor R40 and would result in an undesirable shortening of the injection time even during normal engine operation. If the starting control using the resistor R38 were used, this residual current would result in a voltage drop across the resistor R36, thereby diminishing all of the control voltages $U_s$, and resulting in a corresponding undesirable extension of the injection time. The resistor R75, which now carries all of the residual current of transistor T26, practically raises the collector potential or the potential at the cathode of diode D1 to that of the supply line 7. This blocks the diode D1 and the discharge current source becomes independent at both points of engagement from the residual current of the transistor. The blocking current through the diode is too small to cause any difficulty.

The foregoing is a description of a preferred embodiment of the invention and many variants and other embodiments are possible within the spirit and scope of the invention, the latter being defined by the appended claims.

What is claimed is:

1. In an electronic fuel injection system for an internal combustion engine, said system including:

an electromagnetic fuel injection valve associated with each engine combustion chamber;

control multivibrator means including a timing capacitor for defining the time constant thereof and constant current sources to charge and discharge said timing capacitor for generating control pulses of variable length for said electromagnetic fuel injection valves;

means for sensing combustion air flow rate and engine rpm and for supplying control signals related to these variables to said control multivibrator means; and a final output stage, controlled by said control multivibrator means, for actuating said injection valves;

the improvement comprising:

a trigger circuit, triggered in synchronism with the rotational speed of the engine and jointly connected to said final output stage, thereby defining the onset of fuel injection control pulses and also to said multivibrator for flipping said multivibrator to its unstable state, said multivibrator being connected to said final output stage to thereby define the duration of the output pulses due to controlled discharge of said timing capacitor.

2. In an electronic fuel injection system for an internal combustion engine, said system including:

an electromagnetic fuel injection valve associated with each engine combustion chamber;

control multivibrator means including a timing capacitor and constant current sources to charge and discharge said timing capacitor for generating control pulses for said electromagnetic fuel injection valves, and including a monostable multivibrator composed of first and second transistors (T20, T21) said timing capacitors being connected beween the control electrode of said first transistor (T20) and said second transistor (T21), thereby defining a first feedback path and further including a cascade of transistors (T33, T22, T23, T35, T37) connected between the control electrode of said second transistor (T21) and said first transistor (T20), thereby defining a second feedback path; whereby one transistor in said cascade of transistors, directly controls the base of the following transistor in said cascade;

means for sensing combustion air flow rate and engine rpm and for supplying control signals related to these variables to said control multivibrator means; and a final output stage, controlled by said control signals, for actuating said injection valves;

the improvement comprising:

a trigger circuit, triggered in synchronism with the rotational speed of the engine and jointly connected to said first output stage, thereby defining the onset of fuel injection control pulses and also to said monostable multivibrator for flipping said multivibrator to its unstable state, said multivibrator being connected to said final output stage to thereby define the duration of the output pulses due to controlled discharge of said timing capacitor.

3. An apparatus as defined by claim 2, wherein the control electrode of said transistor T37 in the second feedback path of said monostable multivibrator is connected to said trigger circuit to thereby receive the control pulse from said trigger circuit for flipping the monostable multivibrator.

4. An apparatus as defined by claim 3, further including a bistable multivibrator consisting of transistors T34, T38, connected to the transistors in said second feedback path, said bistable multivibrator being flipped at the onset of the return of said monostable multivibrator to its stable state for the rapid return of the monostable multivibrator from its metastable state after the discharge of said capacitor.

5. In an electronic fuel injection system for an internal combustion engine, said system including:

an electromagnetic fuel injection valve associated with each engine combustion chamber;

control multivibrator means including a timing capacitor and constant current sources to charge and discharge said timing capacitor for generating control pulses for said electromagnetic fuel injection valves; and wherein said current source for discharging said timing capacitor includes first and second operational amplifiers, the output from said first operational amplifier is connected directly to one electrode of a resistor and the output from said second operational amplifier is connected to the other end of said resistor via a Darlington circuit including two transistors, one input of each operational amplifier being connected to that electrode of said resistor also connected to its output, the other inputs of said operational amplifiers receiving a signal related to combustion air flow rate, said discharge current source further including a voltage divider circuit composed of two divider resistors connected in series between the positive and negative supply lines of the circuit, the junction of said divider resistors being connected to said resistor; whereby the offset voltages of said operational amplifiers may be compensated by adjustment of one of said divider resistors;

means for sensing combustion air flow rate and engine rpm and for supplying control signals related to these variables to said control multivibrator means; and a final output stage, controlled by said control signals, for actuating said injection valves;

the improvement comprising:

a trigger circuit, triggered in synchronism with the rotational speed of the engine and jointly connected to said final output stage, thereby defining the onset of fuel injection control pulses and also to said monostable multivibrator for flipping said multivibrator to its unstable state, said multivibrator being connected to said final output stage to thereby define the duration of the output pulses due to controlled discharge of said timing capacitor.

6. In an electronic fuel injection system for an internal combustion engine, said system including:

an electromagnetic fuel injection valve associated with each engine combustion chamber;

control multivibrator means including a timing capacitor and constant current sources to charge and discharge said timing capacitor for generating control pulses for said electromagnetic fuel injection valves; and wherein said current source for charging said timing capacitor includes an operational amplifier whose output is connected through a Darlington circuit to an output resistor carrying said charging current and further includes voltage divider means for supplying one of the inputs of said operational amplifier, the junction of said output resistor and the output of said Darlington circuit being connected through a further resistor with a variable voltage source whose output voltage is dependent on the ambient air pressure, thereby providing altitude compensation for said apparatus;

means for sensing combustion air flow rate and engine rpm and for supplying control signals related to these variables to said control multivibrator means; and a final output stage, controlled by said control signals, for actuating said injection valves;

the improvement comprising:

a trigger circuit, triggered in synchronism with the rotational speed of the engine and jointly connected to said final output stage, thereby defining the onset of fuel injection control pulses and also to said monostable multivibrator for flipping said multivibrator to its unstable state, said multivibrator being connected to said final output stage to thereby define the duration of the output pulses due to controlled discharge of said timing capacitor.

7. An apparatus as defined by claim 1, wherein the control electrode of said trigger circuit is connected to the junction of a capacitor and a resistor for the purpose of providing an input differentiating sub-circuit, and wherein the capacitance of said capacitor and the resistance of said resistor are both adjustable for providing adjustment of the duration of the triggering pulse from said trigger circuit.

8. An apparatus as defined by claim 7, wherein said trigger circuit includes a transistor (T40) with two collector electrodes K1, K2, whose base electrode is connected to the junction between a capacitor C6 and a resistor R66 which constitute a differentiating input circuit and whose emitter is connected through a resistor R68 to the positive supply line of the circuit and whose one collector K1 is connected in series with two resistors R70, R71 to the opposite supply line 8.

9. An apparatus as defined by claim 8, wherein the junction of the two collector resistors R70, R71 of said transistor T40 is connected to the base of a first output transistor T24 whose collector is connected to the base of a second output transistor T25 and wherein the collector of said second output transistor T25 carries output control pulses for said electromagnetic fuel injection valves and wherein the collector of said second output transistor is connected through a resistor R73 to one of the supply lines of the circuit.

10. An apparatus as defined by claim 8, wherein the second collector K2 of the transistor T40 in said trigger circuit is connected through a resistor R67 to the base of a transistor T39 one of whose remaining electrodes is connected to the control electrode of one of said transistors in said bistable multivibrator.

11. An apparatus as defined by claim 2, further including:

a bistable multivibrator consisting of transistors (T34, T38), connected to the transistors in said second feedback path, said bistable multivibrator being flipped at the onset of the return of said monostable multivibrator to its stable state for the rapid return of the monostable multivibrator from its metastable state after the discharge of said capacitor, and wherein said monostable multivibrator includes a first transistor (T20) and a second transistor (T21) and wherein the base of said first transistor (T20) is connected to one electrode of said timing capacitor (C2) and wherein the emitter of said first transistor (T20) is connected to one of the supply lines of the circuit and wherein the collector of said transistor (T20) is connected to the base of an emitter-follower transistor (T33) to whose emitter are connected in series resistors (R51, R53, R65) and the junction of two of said series resistors (R53, R65) is connected to the base of said transistor (T38) in said bistable multivibrator and wherein the emitter of said transistor (T33) is connected in series with resistors (R51, R50) to the base of said transistor (T22) in said cascade connected to said second feedback path of the monostable multivibrator.

12. An apparatus as defined by claim 11, wherein the values of said resistors R51, R50, R53, R65 are so chosen that during the onset of collector current of said first transistor T20 in said monostable multivibrator and the occurrence of an associated emitter current in said transistor T33, said bistable multivibrator T34, T38 flips abruptly into its opposite state and wherein the collector of said transistor T34 in said bistable multivibrator is connected to the emitter of said transistor T33 whereby, independently of the switching state of said transistor T20, the switching of said transistors in said cascade (T22, T23, T35, T37) effects an abrupt flip-back of said monostable multivibrator.

13. An apparatus as defined by claim 12, wherein the collector of the first cascade transistor T22 in the second feedback path of said monostable multivibrator is connected to the base of the next cascade transistor T23 and wherein the collector of the transistor T23 is connected to the base of the subsequent cascade transistor T35 whose collector is connected to the base of the final cascade transistor T37 and wherein the base of said final transistor T37 also receives the trigger output pulse from said trigger circuit and wherein the collector of said final cascade transistor T37 is connected to the base of the second transistor T21 in said monostable multivibrator.

14. An apparatus as defined by claim 13, wherein the emitters of all transistors T22, T23, T35, T37 in the second feedback path of said monostable multivibrator are connected directly to one of the voltage supply lines of the circuit while their collectors are connected through resistor divider circuits to the other voltage supply line of the circuit and wherein points between the collectors of said transistors and said resistors are connected to the control electrode of the subsequent transistor in the cascade.

15. An apparatus as defind by claim 14, further including an emitter-follower transistor T36 associated with said transistor T21 of said monostable multivibrator.

16. An apparatus as defined by claim 15, including a connection between the output of said operational amplifier in said current source for charging said timing capacitor and the base of the first cascade transistor T22 in the second feedback path of said monostable multivibrator.

17. An apparatus as defined by claim 16, wherein the output of said operational amplifier 16 of the charging current source is connected in series with two resistors R47, R48 to one of the voltage supply lines of the circuit and wherein the junction of said resistors R47, R48 is connected to the base of said first cascade transistor T22 in the second feedback path of said monostable multivibrator; whereby, if the output of said operational amplifier 16 carries a potential, the feedback path of said monostable multivibrator is blocked.

18. An apparatus as defined by claim 1, wherein said current source for discharging said timing capacitor includes an operational amplifier 12 whose non-inverting input is connected in series with an adjustable resistor 38 and a diode D1 to the collector of a transistor T26 whose emitter is connected to one of the voltage supply lines of the circuit and whose base receives control pulses related to the occurrence of engine starting and wherein the non-inverting input of said operational amplifier 12 is provided with an input resistor R36 to which are supplied said signals related to combustion air flow rate.

19. An apparatus as defined by claim 18, further including a second operational amplifier 13, the output of said first operational amplifier 12 is connected through a Darlington circuit T27, T28 to the output of said second operational amplifier 13 through an output current resistor R39 and wherein the junction of said output current resistor R39 and the emitter of the final transistor T28 in said Darlington circuit is connected via an adjustable resistor R40 to the anode of said diode D1.

20. An apparatus as defined by claim 19, wherein the collector of said transistor T26 is connected in series with a resistor R75 to the other of the voltage supply lines of the circuit.

* * * * *